US006253891B1

(12) United States Patent
Miller

(10) Patent No.: US 6,253,891 B1
(45) Date of Patent: Jul. 3, 2001

(54) REMOVABLE WHEEL SYSTEM

(75) Inventor: Jacqueline N. Miller, Boca Raton, FL (US)

(73) Assignee: Travelpro International, Inc., Boca Raton, FL (US)

( * ) Notice: Subject to any disclaimer, the term of this patent is extended or adjusted under 35 U.S.C. 154(b) by 0 days.

(21) Appl. No.: 09/375,058

(22) Filed: Aug. 16, 1999

(51) Int. Cl.[7] ..... A45C 13/00; A45C 5/00; B60B 23/00; B60B 27/02

(52) U.S. Cl. ..... 190/18 A; 301/111; 301/121

(58) Field of Search ..... 301/111, 114, 301/125, 121; 190/18 AI

(56) References Cited

U.S. PATENT DOCUMENTS 4,995,487 * 2/1991 Plath ..... 190/18 A
5,323,886 * 6/1994 Chen ..... 190/18 A
5,499,702 * 3/1996 Wang ..... 190/18 A
5,524,737 * 6/1996 Wang ..... 190/18 A
5,575,361 * 11/1996 Chou ..... 190/18 A
5,590,748 * 1/1997 Chang ..... 190/18 A
5,873,145 * 2/1999 Chou ..... 301/111
5,918,710 * 7/1999 Sher ..... 190/18 A

* cited by examiner

*Primary Examiner*—S. Joseph Morano
*Assistant Examiner*—Jason R. Bellinger
(74) *Attorney, Agent, or Firm*—Akerman Senterfitt

(57) ABSTRACT

A wheel unit for an article of luggage equipped with wheels to facilitate translation of the luggage along the ground. The wheel unit includes a wheel housing connected to the luggage, and a wheel support and a wheel rotatably but removably connected to the wheel housing, the wheel support being mounted to the wheel housing in such a way that it is easily removable. The wheel may be quickly and easily replaced when damaged without disassembly of any other part of the luggage article.

25 Claims, 6 Drawing Sheets

REMOVABLE WHEEL SYSTEM

BACKGROUND OF THE INVENTION

1. Field of the Invention

The present invention relates to a wheel unit for an article of luggage, and, more particularly, to a wheel unit which includes a wheel housing, a wheel support releasably connectable thereto, and a wheel rotatably connected to the wheel support. The wheel support and wheel may be quickly and easily disconnected from the wheel housing to permit replacement of the wheel when damaged.

2. Background Art

It is common for luggage manufacturers to provide articles of luggage with wheel units to facilitate translation of the luggage along the ground. In the event of damage to the wheel unit, it may become necessary to replace only the actual wheel. Often times, however, due to the structure of the luggage article, removal and replacement of the wheel is a complex, tedious, and expensive task, which requires the use of special tools and can involve having to remove the entire wheel unit or dismantle the article of luggage.

Currently, most wheel assemblies used for rolling luggage are integrally attached to the frame or superstructure of the luggage article. Inevitably, some amount of wheel failure occurs, either due to a defect inherent in the wheel itself, misuse, or both. Due to the nature of the attachment of the wheel to the luggage, repair of the problem requires partial disassembly of the luggage article, which may (and usually does) include removing at least a portion of the interior lining to gain access to the back of the wheel housing, removing riveted parts and other time-consuming, costly and unnecessarily destructive steps.

It would be advantageous, therefore, to be able to replace the wheel without removing the entire wheel housing or dismantling or entering the luggage article.

SUMMARY OF THE INVENTION

Accordingly, the wheel unit of the present invention includes a wheel housing attached to or integrally formed with a suitcase, which preferably defines an inner wheel well which is at least partially recessed within the article of luggage, a wheel support member defining a corresponding outer wheel well adapted to fit within the inner wheel well, and a wheel and axle suspended on the wheel support.

The wheel support attaches to the wheel housing plate by a screw or other removable fastener passed through the rear wall of the wheel housing and a tongue and slot arrangement defined by the wheel housing and wheel support, respectively. Alternatively, the slot may be defined by the wheel housing and the tongue defined by the wheel support.

If the wheel becomes damaged or otherwise needs replacing, it can be removed by removing the fastener using a simple screwdriver in the case where the fastener is a screw, disengaging the tongue from the slot, removing the wheel support completely from the wheel housing, and either replacing the wheel in the existing wheel support or replacing the wheel support and wheel/axle assembly entirely.

It is, therefore, a principle object of this invention to provide a luggage wheel assembly structure which permits the easy, rapid and efficient replacement of a damaged wheel on an article of luggage.

It is also an object of this invention to provide a wheel assembly for an article of luggage which has enhanced strength yet is easy to repair or replace.

In accordance with these and other objects which will become apparent hereinafter, the instant invention will now be described with particular reference to the accompanying drawings.

DETAILED DESCRIPTION OF THE PREFERRED EMBODIMENT

Figure 1:
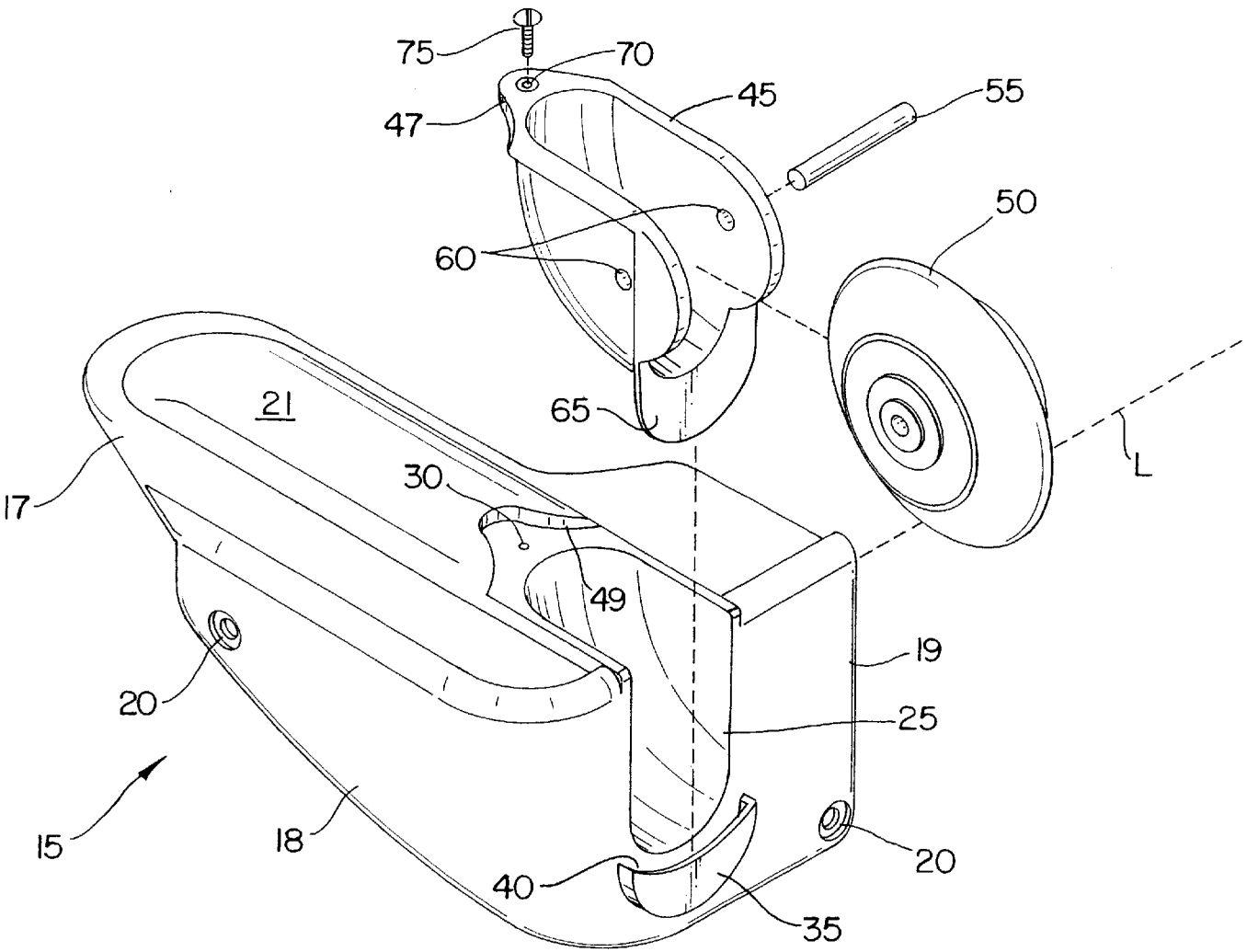
FIG. 1 is an exploded perspective view of the wheel assembly in accordance with the invention.
Figure 2:
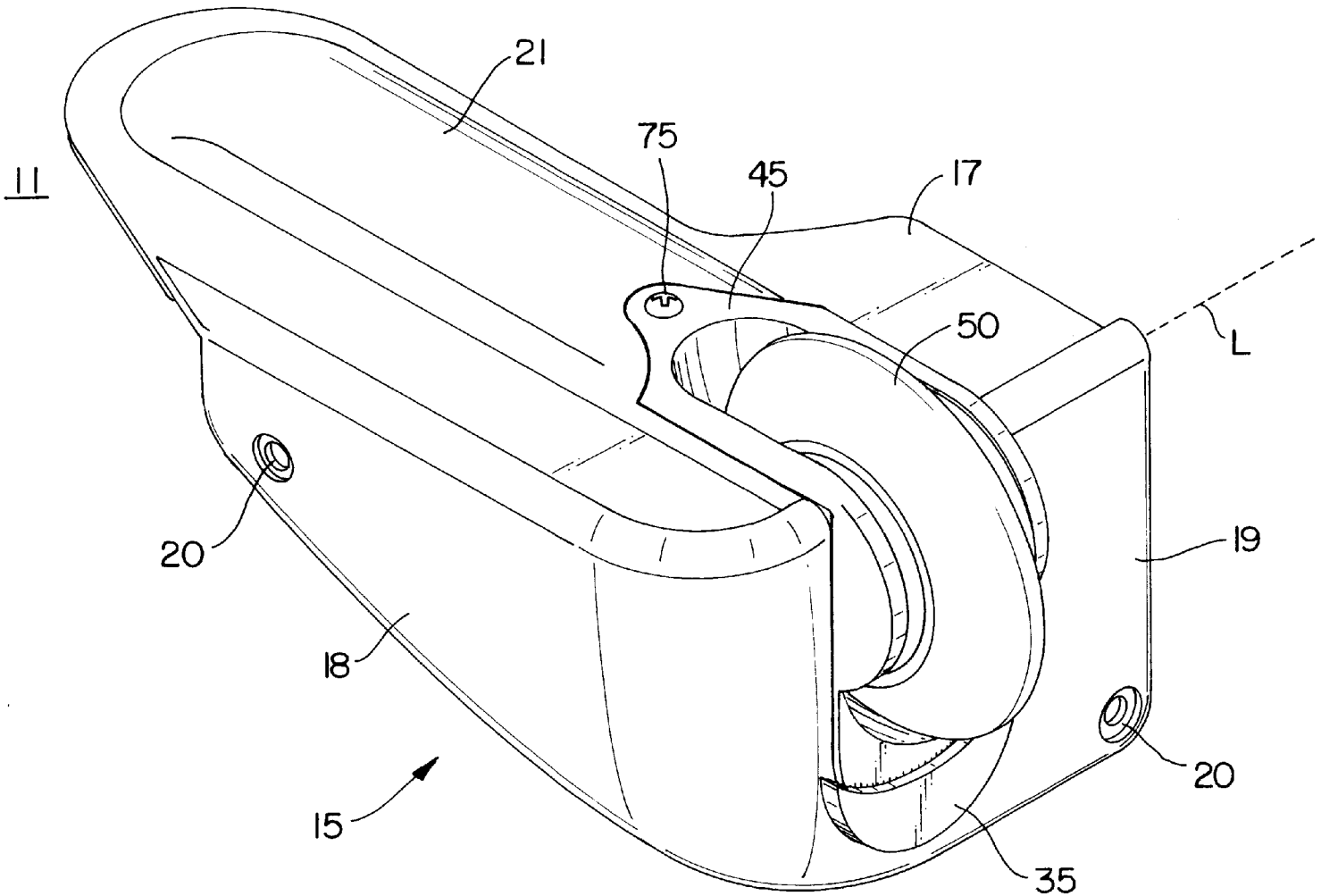
FIG. 2 is a perspective view of the wheel assembly in accordance with the invention.
Figure 3:
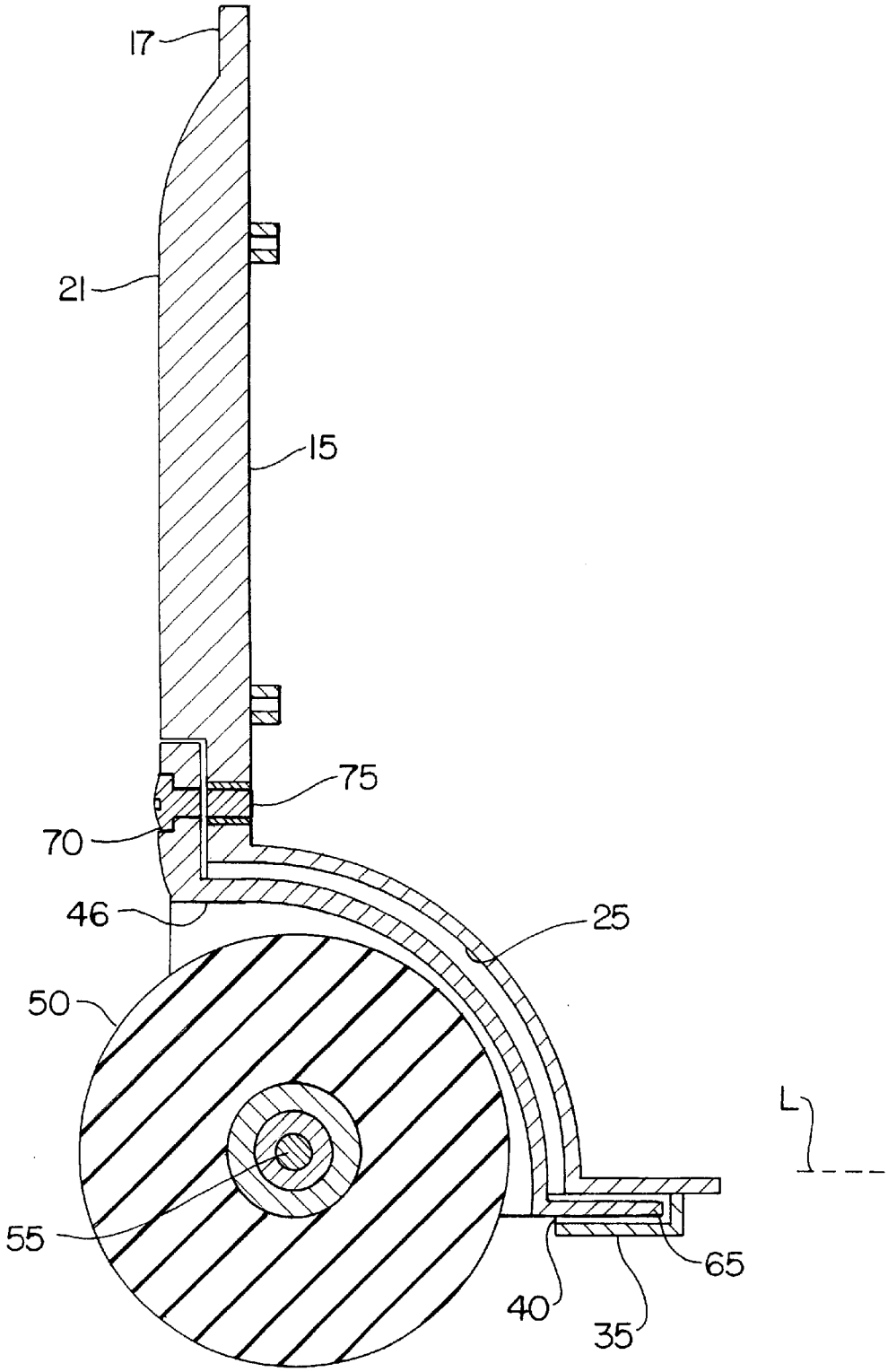
FIG. 3 is a cross-sectional view of the wheel assembly in accordance with the invention.

Referring to FIGS. 1–3, an improved luggage wheel assembly 10 is shown which includes a wheel housing 15 having multiple apertures 20 through which fasteners may be passed to attach housing 15 to the lower edge L of an article of luggage 11 (shown in phantom). Housing 15 is comprised of vertical sidewall 17 and rear wall 18 and a horizontal bottom wall 19. Housing 15 defines a wheel well or chamber in the form of depression 25, a fastener-receiving bore 30 disposed adjacent to the upper portion of chamber 25, and a hollow sleeve 35 on bottom wall 19 which defines a slot 40.

Figure 5:
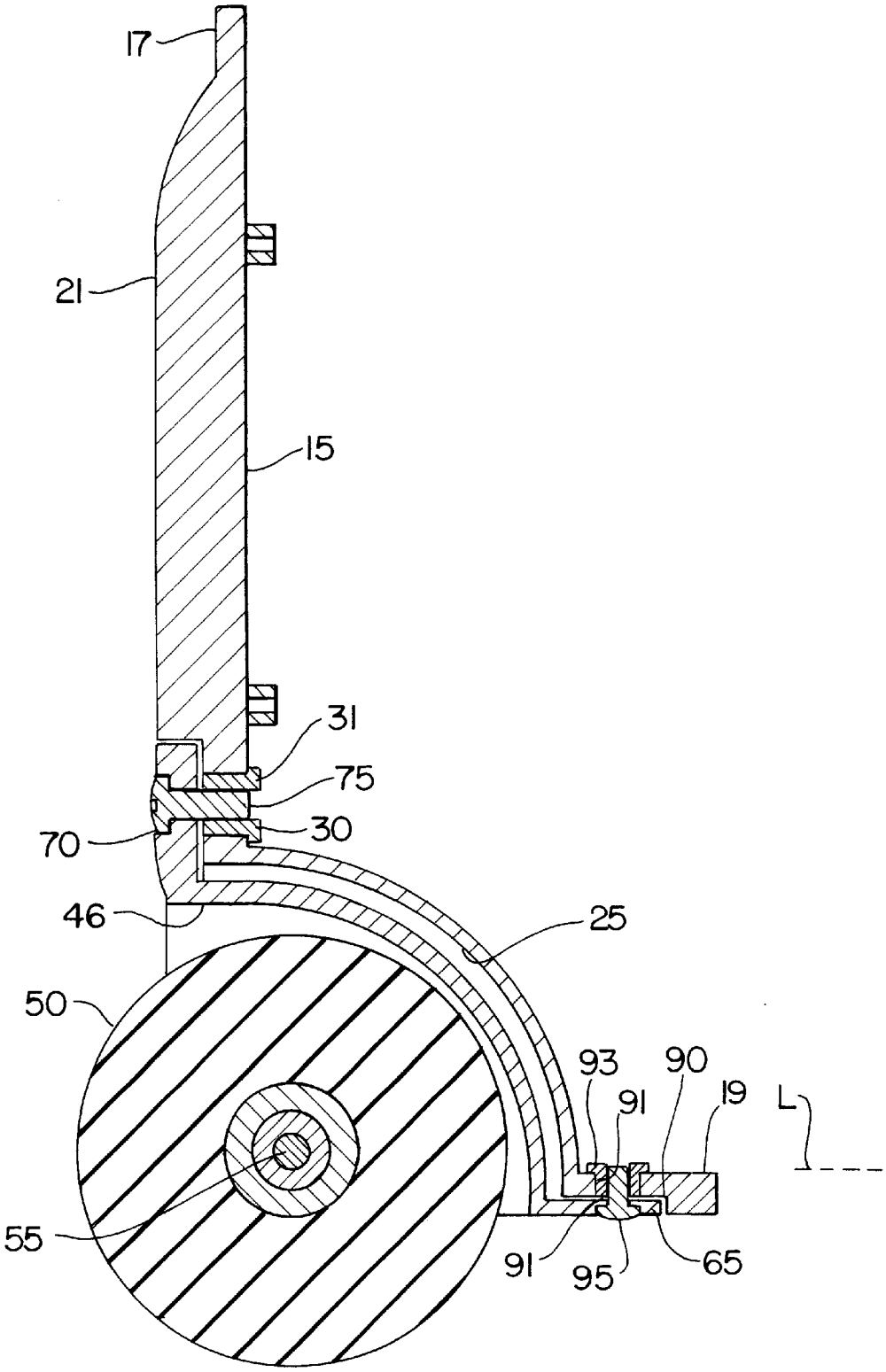
FIG. 5 is a cross-sectional view of the alternative embodiment of the invention.

Side wall 18 of plate 15 may constitute a portion of the side of the luggage article 11 near lower edge L of the article 11. Likewise, rear wall 17 and bottom wall 19 may make up a portion of the rear and bottom walls, respectively, of the luggage article 11. However, the invention is not intended to be limited to that configuration. All that is needed is a mounting structure to which the removable wheel housing and wheel can be mounted. Therefore, as seen in FIG. 5, the wheel wall depression 25 may be an integral component of the luggage article itself.

Wheel 50 is mounted in a depression such as wheel well 46 defined by wheel support 45 on an axle 55 which is inserted into and suspended by axle holes 60. Support 45 also defines a tongue 65 and a fastener hole 70. Depression 46 conforms generally to depression 25.

The wheel support 45 is mounted in depression 25 by axially engaging tongue 65 into slot 40 and inserting a removable fastener 75 such as a screw through aligned fastener aperture 70 and bore 30 which is threaded if fastener 75 is threaded.

Figure 1A:
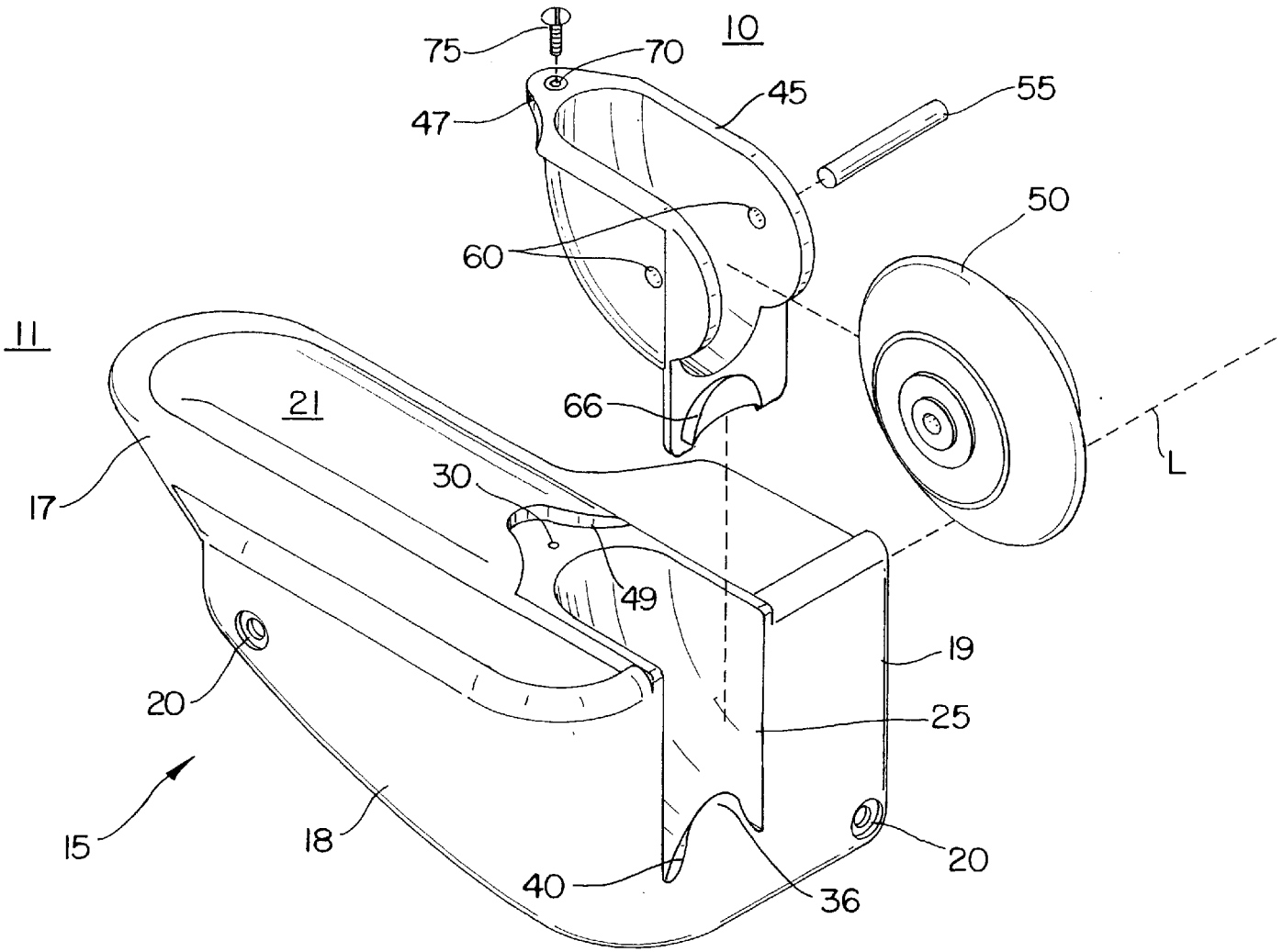
FIG. 1A is an exploded perspective view of a slightly modified version of the wheel assembly of FIG. 1 in accordance with an alternative embodiment of the present invention.

To remove housing 45 from wheel housing 15, fastener 75 is disengaged from aperture 70 and bore 30, after which support 45 is removed from chamber 25 by axially disengaging tongue 65 from slot 40. In an alternative embodiment as shown in FIG. 1A, a slot 66 may be defined by the wheel support 45 and a tongue 36 may be defined by the wheel housing 15, wherein the slot 36 and tongue 66 axially engage and disengage in a similar fashion as the slot 40 and tongue 65 of FIG. 1.

FIG. 3 is a cross-section showing wheel support 45 connected to wheel housing 15, with tongue 65 engaged in groove 40, and aperture 70 aligned with bore 30. As shown in FIG. 5, a threaded sleeve 31, preferably of metal or other durable material, may be inserted into bore 30 so as to insure that fastener 75 will not degrade the threads, such as by stripping them.

Rear wall 17 may include a raised rib 21 which defines a lower curved face 49. A correspondingly shaped upper face 47 defined by support 45 mates with face 49, which acts as an attaching formation to assist in the centering of apertures 30 and 70 when mounting support 45 to housing 15, in addition to providing lateral and vertical strength to the connection. Rib 21 acts as a contact surface to assist in dragging the luggage article up curbs and the like.

Housing 15 and support 45 may be constructed of any suitable material such as high-impact plastic or metal.

Figure 4:
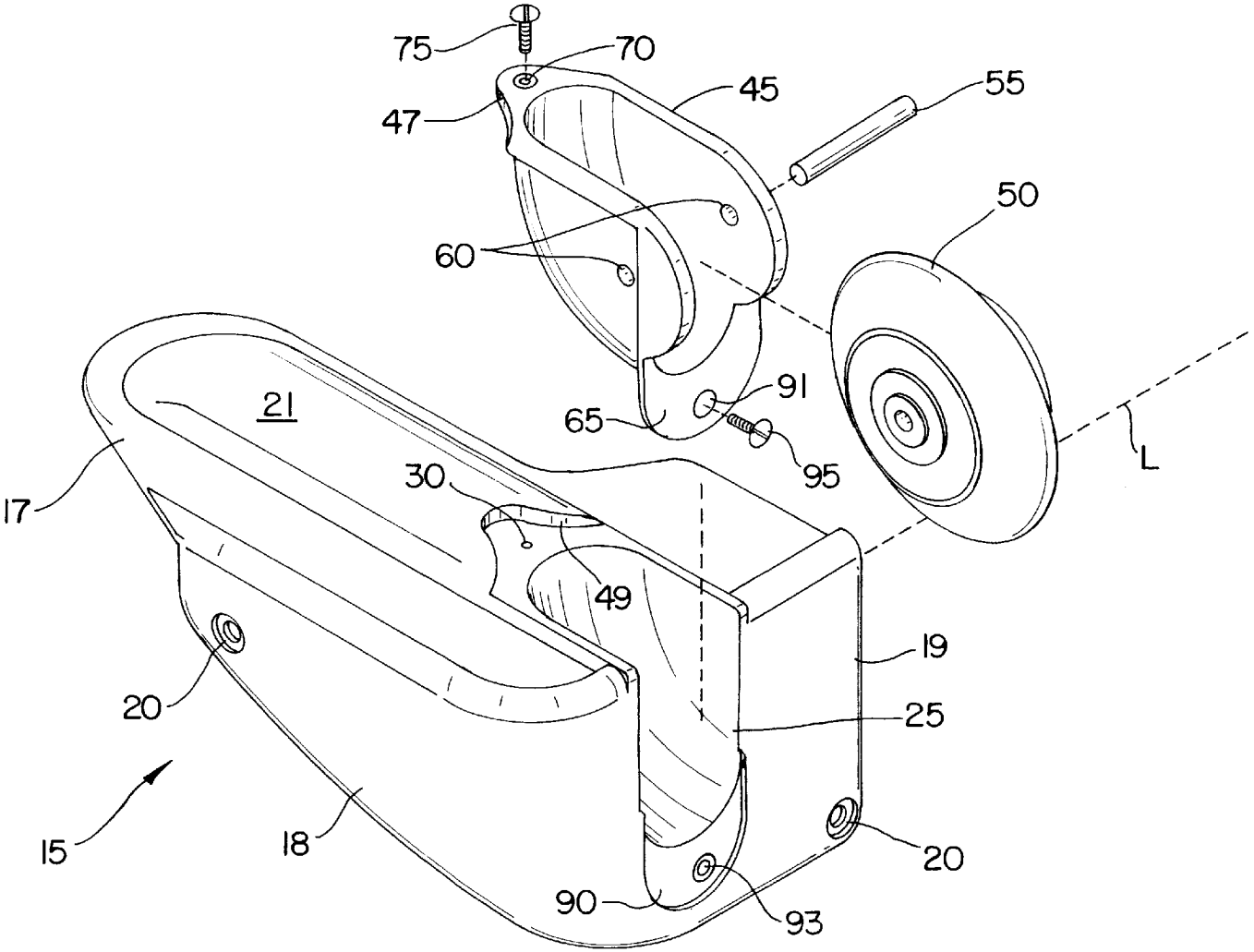
FIG. 4 is an exploded perspective view of an alternative embodiment in accordance with the invention.

FIGS. 4 and 5 show a slightly modified version of the invention wherein sleeve 35 is replaced by a recess 90 defined by lower wall 19 of housing 15. The recess preferably corresponds in its inner contour to the outer shape of tongue 65, which may be square, rounded or any other shape. A fastener such as screw 95 may be passed through a corresponding bore 91 defined by tongue 65 which aligns with a threaded bore 94 defined by lower wall 19 of housing 15. A metal insert such as internally threaded metal sleeve 93 may be utilized.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A luggage wheel system for an article of luggage, comprising:

a wheel housing connected to an article of luggage and defining a wheel support receiving depression at least partially recessed within the article of luggage;

a wheel support removably connected to said wheel housing, said wheel support including a wheel well adapted to be received at least partially within said depression; and a tongue and slot arrangement defined by said wheel housing and said wheel support wherein a tongue is inserted into a slot to engage the wheel housing with the wheel support.

2. The wheel system of claim 1, wherein the wheel support includes a tongue adapted to be received by a corresponding slot defined by said housing.

3. The wheel system of claim 1, further including a wheel rotatably mounted on said support.

4. The wheel system of claim 2, further including a wheel rotatably mounted on said support.

5. The wheel system of claim 1, wherein said wheel well includes a curved wall corresponding generally to said depression.

6. The wheel system of claim 1, further including a means for centering said support with respect to said housing.

7. The wheel system of claim 6, wherein said means for centering is comprised of a curved face defined by a raised rib connected to said housing and a correspondingly shaped face defined by said housing.

8. The wheel system of claim 1, wherein the housing includes a tongue adapted to be received by a corresponding slot defined by said support.

9. The wheel system of claim 8, further including a wheel rotatably mounted to said support.

10. A luggage wheel system, comprising:

a wheel support removably mounted to a lower edge of a suitcase and at least partially recessed within said suitcase, wherein the wheel support is removably mounted to a wheel housing that is mounted external to the suitcase;

a wheel rotatably mounted to said wheel support;

means for removably attaching said wheel support to said suitcase, wherein said means comprises a tongue and slot arrangement defined by said wheel housing and said wheel support wherein a tongue is inserted into a slot to engage the wheel housing with the wheel support.

11. The wheel system of claim 10 in which said means for removably attaching includes a tongue connected to said housing and a corresponding slot defined by said suitcase for receiving said tongue.

12. The wheel system of claim 10, in which said means for removably attaching includes a tongue connected to said suitcase and a corresponding slot defined by said housing for receiving said tongue.

13. The wheel system of claim 10, wherein said means for removably attaching is at least one threaded fastener.

14. A method for replacing a wheel on a wheeled luggage article, comprising the steps of providing a wheel support and wheel housing coupled together by using a tongue and slot arrangement defined by said wheel housing and said wheel support wherein a tongue is inserted into a slot to engage the wheel housing with the wheel support to form a wheel assembly connected to the article of luggage, a wheel and axle assembly being suspended on said wheel support; disengaging said wheel support from said wheel housing by at least disengaging the tongue from the slot and thereby disengaging said wheel support from said article of luggage; removing the wheel from the wheel support, providing a new wheel and rotatably affixing said new wheel to said support; and re-attaching said support to said article of luggage by at least engaging the tongue with the slot.

15. The method of claim 14 further including providing a tongue connected to said support and a corresponding slot defined by said luggage article, and wherein the step of re-attaching the support to the luggage article includes inserting the tongue into the slot.

16. The method of claim 14, further including the step of providing an attaching formation defined by said support adapted to mate with a correspondingly-shaped attachment formation defined by said article of luggage.

17. A wheel system for a rollable luggage article which is removable with a screwdriver, comprising:

a wheel housing externally connected to the rollable luggage article and defining a wheel support receiving depression at least partially recessed within the article of luggage; and a wheel support removably connected to said wheel housing by one threaded fastener, said wheel support including a wheel well adapted to be received at least partially within said depression.

18. The wheel system of claim 17, wherein the wheel support includes a tongue adapted to be received by a corresponding slot defined by said housing.

19. The wheel system of claim 17, further including a wheel rotatably mounted on said support.

20. The wheel system of claim 18, further including a wheel rotatably mounted on said support.

21. The wheel system of claim 17, wherein said wheel well includes a curved wall corresponding generally to said depression.

22. The wheel system of claim 17, further including a means for centering said support with respect to said housing.

23. The wheel system of claim 22, wherein said means for centering is comprised of a curved face defined by a raised rib connected to said housing and a correspondingly shaped face defined by said housing.

24. The wheel system of claim 17, wherein the housing includes a tongue adapted to be received by a corresponding slot defined by said support.

25. The wheel system of claim 24, further including a wheel rotatably mounted to said support.

* * * * *